US006516578B1

(12) United States Patent
Hunsaker

(10) Patent No.: US 6,516,578 B1
(45) Date of Patent: Feb. 11, 2003

(54) THIN BRICK PANEL SYSTEM

(76) Inventor: Garrick W. Hunsaker, 1058 W. Corral Cir., West Jordan, UT (US) 84088

( * ) Notice: Subject to any disclaimer, the term of this patent is extended or adjusted under 35 U.S.C. 154(b) by 0 days.

(21) Appl. No.: 09/781,350

(22) Filed: Feb. 12, 2001

(51) Int. Cl.[7] ..... E04F 13/14

(52) U.S. Cl. ..... 52/387; 52/385; 52/389; 52/745.1; 52/747.12

(58) Field of Search ..... 52/311.1, 315, 52/344, 363, 384, 385, 386, 387, 388, 389, 390, 509, 745.1, 745.13, 745.19, 747.11, 747.12

(56) References Cited

U.S. PATENT DOCUMENTS

| | | | | | |
|---|---|---|---|---|---|
| 2,198,466 | A | * | 4/1940 | Stolze | 52/385 |
| 2,208,094 | A | * | 7/1940 | Crandell | 52/346 |
| 2,392,232 | A | * | 1/1946 | Crafton | 52/410 |
| 3,499,256 | A | * | 3/1970 | Schaaf et al. | 52/483.1 |
| 3,740,910 | A | | 6/1973 | Taylor et al. | |
| 3,740,911 | A | | 6/1973 | O'Leary | |
| 3,908,326 | A | * | 9/1975 | Francis | 52/384 |
| 4,011,702 | A | | 3/1977 | Matyas | |
| 4,241,554 | A | | 12/1980 | Infantino | |
| 4,299,069 | A | * | 11/1981 | Neumann | 52/309.4 |
| 4,407,104 | A | | 10/1983 | Francis | |
| 4,589,241 | A | * | 5/1986 | Volpenhein | 52/315 |
| 4,662,140 | A | | 5/1987 | Porter et al. | |
| 4,809,470 | A | | 3/1989 | Bauer et al. | |
| 4,841,705 | A | * | 6/1989 | Fuhrer | 52/410 |
| 4,956,949 | A | | 9/1990 | Francis | |
| 5,228,937 | A | | 7/1993 | Passeno | |
| 5,311,714 | A | | 5/1994 | Passeno | |
| 5,373,676 | A | | 12/1994 | Francis et al. | |
| 5,501,049 | A | | 3/1996 | Francis et al. | |
| 5,526,630 | A | | 6/1996 | Francis et al. | |
| 6,164,037 | A | | 12/2000 | Passeno | |

OTHER PUBLICATIONS

US Brick Systems brochure, Sweets Catalog, 1995, vol. 2. (sweets reference No. 04245/USB, BuyLLne2736).*
*Western Thin Brick and Tile*, Brochure.
*Harristone*, Brochure.
*US Brick Systems*, Installation Guide and Details.
*US Brick Systems*, Brochure.
*Cultured Stone Product Selection Guide*, Brochure.

* cited by examiner

*Primary Examiner*—Carl D. Friedman
*Assistant Examiner*—Brian E. Glessner
(74) *Attorney, Agent, or Firm*—Stoel Rives LLP

(57) ABSTRACT

A thin brick panel system and method of forming a thin brick wall includes an expanded polystyrene foam panel having a plurality of laterally extending channels formed therein for receiving a plurality of thin brick units. The thin brick units are bonded with an adhesive directly to the foam panel and the seams between adjacent brick are filled with a mortar that bonds to the foam panel. The foam panel may be attached to a substrate with an adhesive as well as fasteners. Strips of a mesh fabric may span several panels to bind the panels together to form a structurally sound thin brick wall.

20 Claims, 5 Drawing Sheets

THIN BRICK PANEL SYSTEM

BACKGROUND

1. Field of the Invention

The present invention relates to a method and apparatus for forming a brick panel wall. More particularly, the present invention relates to a brick panel system which utilizes "thin brick" members in conjunction with a foam backing for attachment to an existing structure or substrate.

2. Description of the Prior Art

Architectural thin face brick, commonly referred to as "thin brick," is typically kiln dried brick units that have height and width dimensions similar to those dimensions of conventional brick, but have a relatively small thickness. Some other thin brick units are formed from concrete, such as those manufactured by Western Thin Brick and Tile in Phoenix Ariz. Such thin brick is typically used as a decorative element to an existing architectural structure. The thin brick is typically applied to the structure with an adhesive and then grouted with mortar to give the resulting panel the appearance of "real" brick. Such a thin brick panel, however, is much lighter than a wall formed from conventional brick, is typically less expensive than a conventional brick wall, and can be applied to the fascia of an existing building, whether that building be new or old construction.

One of the problems identified early on with applying thin brick is the ability to hold the brick in place during the installation process. That is, when a row of thin brick is first applied to an existing wall and the adhesive is still wet, the brick will slip if the brick is not held in place until the adhesive cures. In addition, without some structural support for aligning the brick during the installation process, a skilled brick layer must be employed to properly lay the brick. As such, several attempts have been made in the art to provide structural support for the individual brick members.

One such panel system is disclosed in U.S. Pat. No. 4,809,470 to Bauer et al. Bauer teaches the use of a bonded vacuum formed polystyrene and extruded polystyrene foam. The outer portion is configured to secure bricks in place by a friction fit until the mortar is laid. Channel bars separate the bricks in a vertical direction.

Another brick support structure is provided in U.S. Pat. No. 4,662,140 which includes a sheet of metal having a plurality of tabs punched therein and extending outward from a first side thereof. Also positioned on the first side of the sheet metal panel are adhesive strips for permanently affixing bricks to the panel's first, or outer, side with the bricks positioned in a given spaced array on the panel by the tabs extending therefrom. The tabs provide support for the bricks when initially positioned upon the panel.

Yet another brick panel apparatus, disclosed in U.S. Pat. No. 5,311,714 to Passeno, a stiff backing member such as an extruded polystyrene insulted board is laminated to a water impermeable sheet. A plurality of integrally formed projections are disposed in a plurality of horizontal rows on the impermeable sheet whereby these projections and the sheet constitutes a one-piece structure. The thin bricks are disposed between the rows of projections. Brackets are utilized to attach the thin sheet and backing member to a vertical substrate. The brackets have a planar portion for allowing the fastener to pass through it, through the thin sheet and through the backing member to a vertical structural member. These brackets also have a top portion which supports the bottom of the brick and is configured to engage with the mortar.

A similar thin brick panel assembly to Passeno is disclosed in U.S. Pat. No. 5,501,149 to Francis et al. Francis teaches a brick panel system which includes a backing member formed from a sheet of material adapted to retain individual thin brick tiles. The backing member has a generally uniform cross-section throughout its entire length, providing channels which allow the thin brick tiles to lay uniformly across each row. The channels are defined by retaining bars which hold the thin brick tiles in place. The retaining bars include mortar lock notches which are adapted to provide a dovetail connection between the mortar an the backing board, as well as a path for moisture and water to escape from the brick panel assembly.

The forgoing attempts to provide a way of applying thin brick to an existing structure each have significant disadvantages. For example, the use of dual layer systems, i.e., a first layer configured to hold the brick during installation attached to a second layer comprised of foam, are expensive to manufacture and difficult to adapt to structures that are not planar. Such two layer systems are provided because the foam layer is comprised of a extruded polystyrene. The adhesives used to attach the brick to the panel will disintegrate such foam. Therefore, the foam layer must be protected from adhesive contact. In addition, expensive adhesives must be used to bond the brick to such two layer panel systems.

Another problem with extruded polystyrene is that mortar will not adhere to it. As such, as previously discussed, some of the panel systems of the prior art include brackets which become embedded in the mortar during installation. Such brackets are provided to presumably hold the mortar relative to the panel system. Temperature variations, however, will cause such brackets to expand and contract at a different rate that the mortar, thus causing the mortar joints to crack and/or become dislodged.

Yet another problem with such extruded foam systems is that manufacturers are not able to produce extruded foam over a thickness of about 1.5 inches. Because of the extrusion process used to form such panels, thicker panels become warped and unusable for brick panel systems where walls must remain planar and where any warping in the foam panel would be noticeable in the finished brick wall.

The use of metal sheets is not desirable as such materials often have sharp edges making them dangerous to handle. In addition, temperature variations in such sheets will cause the sheet to expand and contract. The expansion and contraction rate of the metal sheet will be different than that of the mortar, causing the mortar to crack and/or become dislodged. Furthermore, systems which use individual brackets to hold the brick in place are not as easy to use as a system which provide structural support for the brick without the need for additional brackets.

It is known in the art to use expanded polystyrene (EPS) foam boards in stucco applications. In such applications, the foam boards are bonded to an existing structure or substrate with an adhesive. The adhesive is also used to adhere architectural expanded polystyrene foam shapes to cementitious substrates and to embed reinforcing mesh on architectural EPS foam shapes in stucco applications. The adhesive can also be used as a leveling coat and base for cementitious or acrylic finishes in stucco applications. Such materials, however, have not been utilized in thin brick applications. Specifically, it has been perceived that the weight of the brick units, especially when multiplied by the large number of brick units used on a commercial structure, cannot be sufficiently supported by direct attachment to a foam board. compared to stucco, which typically comprises a thin layer of stucco material over the foam board, the brick units have a significantly larger mass per unit area. In addition, mortar is added to fill the gaps between bricks. Thus, the foam board must support significantly more weight than a similar board in a stucco application.

Dislodgement of the bricks or mortar could be dangerous to passers by if the brick units or mortar were to become dislodged and fall to the ground. The prior art systems configured to attach thin brick to an existing structure, however, have problems with bricks and/or mortar becoming dislodged. Indeed, the mortar used to fill gaps between bricks will not bond to the prior art panel systems. As previously described with the prior art systems, it is often the case that a lining sheet of material, such as plastic or metal, is placed between the foam and the brick. Because such materials will have different expansion and contraction rates due to temperature variations than the adhesive, mortar and brick, the mortar is caused to crack and the brick and mortar will become dislodged.

Thus, it would be and advantage to provide a thin brick panel system that allows the brick and mortar to expand and contract at along with the panel system to prevent the brick and mortar attached thereto from becoming dislodged.

It would be another advantage to provide a thin brick panel system that allows bonding of the mortar to the panel system without the need for additional structural support.

It would also be advantageous to provide a thin brick panel system which is simple and relatively inexpensive to manufacture.

It would be a further advantage to provide a thin brick panel system which has relatively few components yet provides sufficient structural support for the brick during installation to prevent the brick from moving until the adhesive used to attach the brick to the panel system cures.

It would yet be another advantage to provide a panel system that utilizes conventional adhesives to attach the brick to the panel system.

It would be another advantage to provide a panel system that prevents the brick and mortar attached thereto from being easily dislodged.

It would be a further advantage to provide a thin brick panel system which is capable of being manufactured in various thicknesses including thicknesses over about 1.5 inches. These and other advantages will become apparent from a reading of the following summary of the invention and description of the preferred embodiments in accordance with the principles of the present invention.

SUMMARY OF THE INVENTION

Accordingly, a thin brick panel system, comprises an expanded polystyrene foam panel having a front side, a back side, a left side and a right side. The front side defines a plurality of laterally extending channels or slots. The channels are each defined by a pair of laterally extending spacing members or rails that are integrally formed with the panel. The panel is utilized to form a brick fascia on the exterior surface of a building or other structure whether the building be new or old construction. More specifically, the panel is configured to secure thin brick units to the building or structure in a manner that gives the appearance that full-sized bricks are utilized.

The thin brick units are inserted into the channels and attached to the panel with an adhesive interposed between the the brick units and the foam panel to bond the brick units directly to the foam panel.

The panel is provided with mating features for mating the sides of the panel with an adjacent panel. The mating features preferably including tongue and groove features that extend the length of the panel.

The spacing members that define the brick channels have a height that is less than the thickness of the brick units. As such, a mortar seam is formed between the brick units for being filled with mortar to give the thin brick a natural brick appearance.

In a preferred embodiment, the laterally extending spacing members have a rectangular cross-section to provide a top surface that can bond to the mortar.

The panel is preferably fastened to an existing structure or a building with an adhesive and/or a mechanical fastener that includes a washer member and a threaded or non-threaded fastener, such as a nail, inserted through the washer member.

In yet another preferred embodiment, a plurality of fabric-like strips of material are seated within the brick channels of the panel between the panel and the brick units. This fabric-like material is preferably comprised of a fiberglass mesh tape, such as the type used in dry wall construction applications. The mesh tape has a length that is wider than a width of the panel for overlapping with adjacent panels and binding together several panels.

The present invention also embodies a method of utilizing the forgoing system to form a brick wall structure in accordance with the principles of the present invention. In order to do so, an adhesive is applied to the channels of a panel and the brick units are pressed into the channels.

When panels are stacked in a vertical arrangement, adjacent panels are fitted together by inserting the mating features provided along a side of one panel with mating features provided along a side of an adjacent panel. Once the adhesive holding the brick to the panel has cured to an appreciable extent, a mortar can be applied between brick units to give the appearance of a solid "full-sized" brick wall.

Initially, the panel of the present invention may be attached to the existing structure with an adhesive or mechanical type fasteners. Obviously, such attachment is performed prior to application of the brick units to the panel.

Additionally, prior to attachment of the brick units, mesh strips may be applied to the panels which are held in place by the mechanical fasteners and/or an adhesive. When the bricks are applied over the mesh strips, the adhesive used to hold the bricks flows into and through the mesh strips to bond to the panel creating a strong bond between the panel, mesh and bricks.

BRIEF DESCRIPTION OF THE DRAWINGS

The foregoing summary, as well as the following detailed description of the preferred embodiments is better understood when read in conjunction with the appended drawings. For the purpose of illustrating the invention, there is shown in the drawings embodiments that are presently preferred and which illustrate what is currently considered to be the best mode for carrying out the invention, it being understood, however, that the invention is not limited to the specific methods and instruments disclosed. In the drawings.

DETAILED DESCRIPTION OF THE PREFERRED EMBODIMENTS

Figure 1:
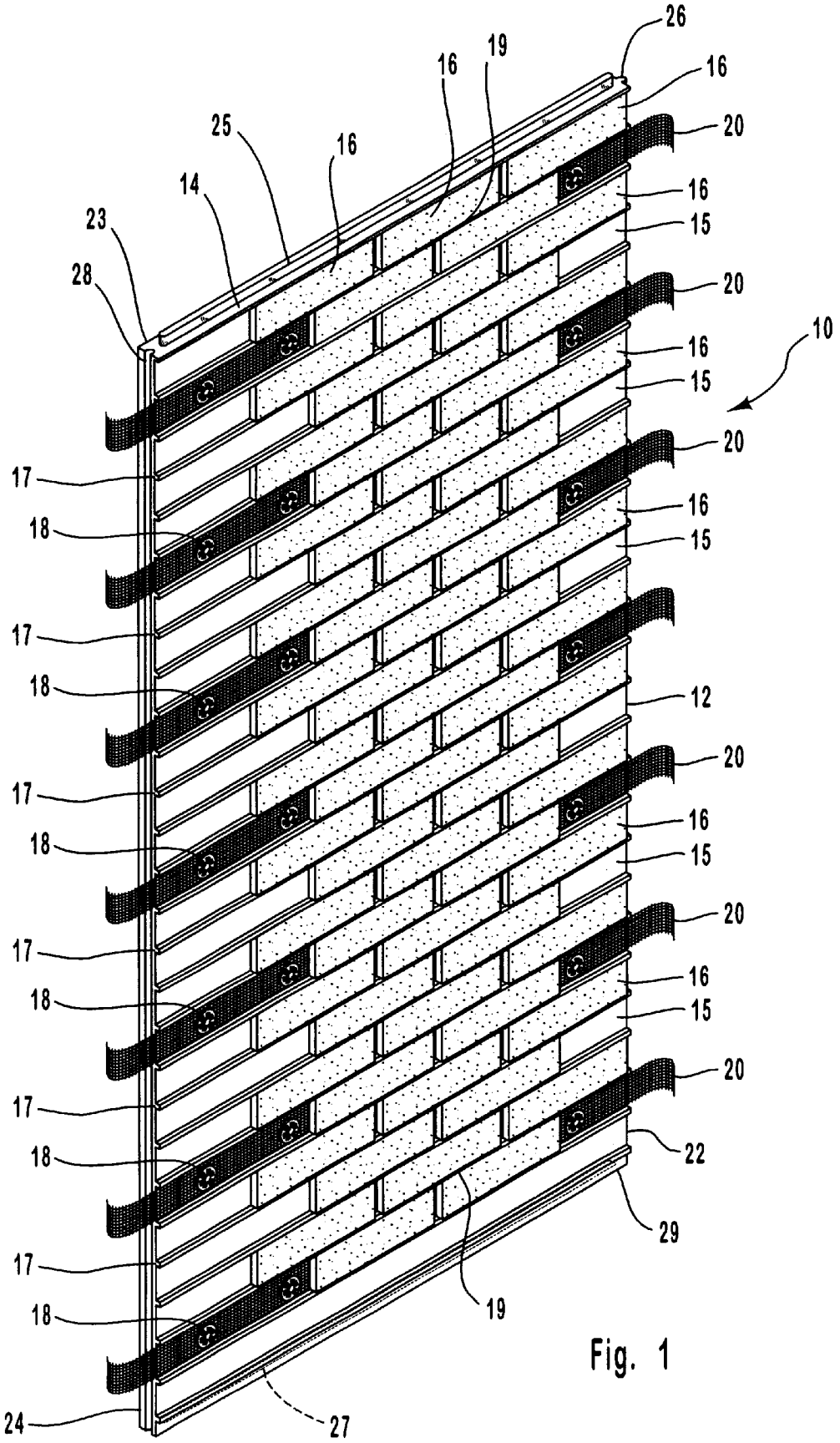
FIG. 1 is a perspective view of a first preferred embodiment of an expanded polystyrene foam panel for a thin brick panel system in accordance with the principles of the present invention.

Referring to the drawings wherein like numerals indicate like elements throughout, there is shown in FIG. 1 a brick panel system, generally indicated at 10, in accordance with the preferred embodiment of the present invention. The brick panel system 10 is comprised of a foam panel 12, formed from an expanded polystyrene insulation material, commonly referred to as beaded polystyrene foam. Boards are produced from molded, close-cell, expanded polystyrene foam plastic. The foam panel 12 may be formed by cutting a sheet of expanded polystyrene foam as with a heated wire into the desired cross-sectional shape. Beaded polystyrene foam can be manufactured in many shapes and sizes and does not have a thickness limitation, as is the case with extruded polystyrene foam products. Accordingly, the panel 12, while illustrated as generally comprising a "sheet" of material, may be formed into any shape or size depending on the needs of the user. For example, as will be described in more detail herein, the panel of beaded polystyrene foam may take into account the building for which the panel system 10 is to be applied. That is, if the structure has variations in its surface topography, the back side 14 of the panel 12 can be preformed to fit over such architectural features. Additionally, in situations where it is desirable to lay the thin brick 16 on the panel in a manner that creates various elevations in the brick panel surface, such elevations can be preformed into the panel. Thus, when a panel providing for various brick elevations is attached to an existing structure, the panel will space the thin brick 16 from the existing structure according to the architect's design without the need for additional materials.

The panel 12 is formed with a plurality of channels 15 which preferably extend across the width of the panel 12. The channels 15 are defined by a plurality of laterally extending spacing members 17 which are integrally formed into the panel 12. The spacing members 17 form rails across the panel to provide proper spacing between adjacent rows of brick 16. Furthermore, the spacing members have a height that is less than the thickness of the brick 16 to form channels 19 between adjacent rows of brick 16 that can be filled with mortar after attachment of the brick 16 to the panel 12. The brick 16 are adhesively attached to the panel 12.

As further illustrated in FIG. 1, the beaded polystyrene foam panel is mounted to an existing structure (not shown) with a plurality of fasteners 18. The fasteners 18 firmly hold the panel 12 against a structure. A plurality of mesh or other fabric type strips 20, such as fiberglass mesh, may also be employed to add additional structural strength to the panel system 10. For example, the mesh strips 20 can span several adjacent panels 12 in order to bind adjacent panels 12 together. The mesh strips 20 preferably have a width similar to the distance between adjacent spacing members 17 so as to fit within the channels 15.

The mesh strips 20 are placed within the same channels 15 as the fasteners 18. Accordingly, the mesh strips 20 help prevent the fasteners 20 from being pulled through the foam panel 12. Furthermore, when the adhesive used to attach the brick 16 to the panel 12 is applied within the channels 15 containing the mesh strips 20, the adhesive becomes interlocked with the mesh strips to provide a strong mechanical bond between the panel 12, the mesh strips 20 and the brick 16. Furthermore, width of the panel 12 can be configured such that the brick 16 installed on the panel 12 can overlap such that brick units 16 in every other row overlap with an adjacent panel 12 to add additional structural strength to the finished wall and to mask the seam between adjacent panels 12.

To facilitate the attachment of adjacent panels 12, the sides 22 and 24 of the panel 12 are provided with tongue and groove features 26 and 28, respectively, which preferably extending the length of the panel 12. As such, the tongue feature 26 of one panel 12 can be inserted into the groove feature 28 of an adjacent panel 12 during installation to help hold the panels 12 together and maintain a substantially planar surface at the joint between adjacent panels 12. Such a planar surface is important in order to maintain a natural brick look to the finished structure. That is, it is highly desirable that the joint between adjacent panels 12 not be visually detectable.

The panel 12 may also include tongue and groove features 25 and 27 along its top and bottom sides 23 and 29, respectively. Preferably, the tongue feature 25 is located on the top edge or side 23 so that when the bottom edge or side of an adjacent panel is abutted against the top side 23 of the panel 12, the tongue feature 25 fits within and thus mates with the groove feature of the adjacent panel (not shown). This arrangement is preferable because, in a situation where water may find its way behind the brick or at least into the seam formed between vertically stacked panels 12, the water will be encouraged to stay in front of the panel 12. That is, by providing the tongue feature 25 on the top 23 of the panel 12, water will not easily be able to flow over the tongue feature 25 to flow to the back side of the panel 12.

Figure 2:
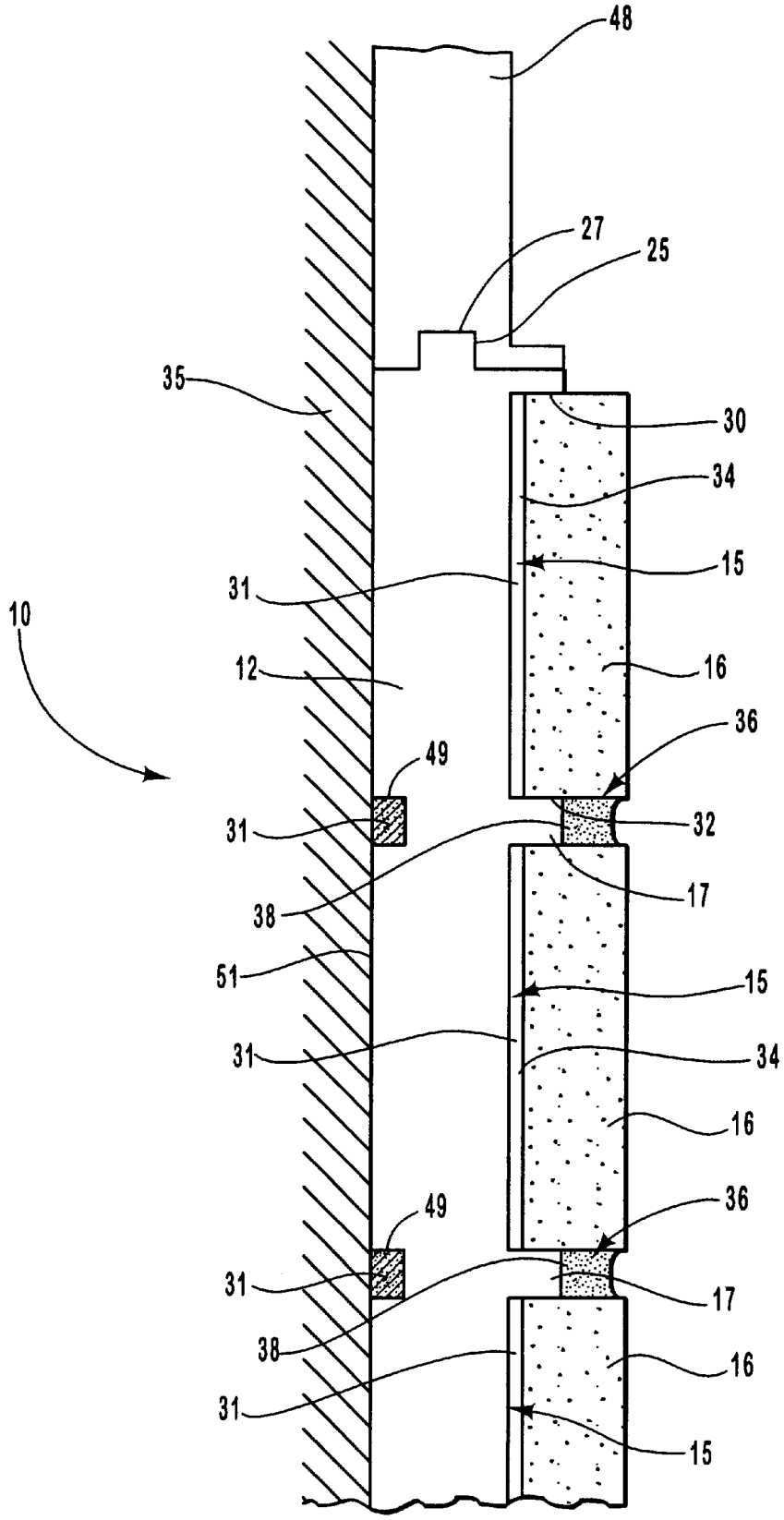
FIG. 2 is a side view of a second preferred embodiment of a thin brick panel system in accordance with the principles of the present invention.

Referring now to FIG. 2, a partial side view of a thin brick panel system 10 is illustrated. The foam panel 12 is provided with channels 15 that extend the width of the panel 12. The brick units 16 are inserted within the channels 15 and abut against the interior sides 30 and 32 of each channel 15. An adhesive 31 is applied to the bottom surface 34 of each channel 15 to hold the brick units 16 to panel 12. Because the panel 12 of the present invention is formed from a beaded polystyrene foam, adhesives that are common in the construction industry may be applied directly to the panel 12 and will not affect the integrity of the panel 12. Such adhesives include polymer-based adhesives, such as those manufactured under the trademark DRYVIT®. These adhesives have conventionally been used on expanded polystyrene foam for stucco applications. Such an adhesive 31 is also utilized to attach the panel 12 to a substrate, such as an existing structure 35.

The lateral protrusions or spacing members 17 provide proper and even spacing between the brick units 16. The spacing members 17 extend from the bottom surface 34 of each channel 15 an amount less than the thickness of the brick units 16. As such, a gap or seam 36 is formed between the top of the spacing members 17 and the sides of adjacent brick units 16. This gap 36 is filled with mortar 38 which bonds to the top of the spacing members 17 and the sides of the brick 16 to form a solid wall when complete. The mortar 38 may comprise a polymer based mortar to ensure that the mortar 38 will bond to the panel 12.

As further illustrated in FIG. 2, a mating feature 25 in the form of a raised portion or tongue is formed preferably along the top surface 23 of the panel 12. As discussed with reference to FIG. 1, this mating feature 25 is configured to mate in a male/female relationship with a recessed mating feature or groove 27 preferably formed along the bottom of another panel 48. Additionally, laterally extending grooves 49 are provided along the back side 51 of the panel 12. In a situation where the panel 12 is bonded to a concrete or masonry structure 35, the panel 12 will be bonded directly to the structure 35, preferably with the same adhesive 31 used to hold the brick units 16 to the channels 15. Thus, the adhesive will be applied to the back side 51 of the panel 12 to bond the panel 12 to the structure 35. The adhesive 31 will flow into the grooves 49 to provide increased surface area for the adhesive 31 to bond and actually adds structural integrity to the bond between the panel 12 and the structure 35.

While more or less such grooves 49 may be formed into the back side 51 of the panel 12, the grooves 49, as shown, are preferably aligned with the spacing members 17 and are generally of the same shape and size. In the manufacturing process of forming such a panel 12, a heated wire or other cutting tool may be employed to cut the channels 15 and the resulting spacing members 17. In order to conserve material, it would be preferable to form multiple panels 12 from a single large block (not shown) of expanded polystyrene foam. By cutting the panels 12 from a single block of material, the grooves 49 will be formed as a result of the cutting process to form the channels 15 in the face of the panel 12. If each panel were to be individually formed, the material removed from the panel 12 to form the channels 15 would simply be wasted.

Figure 3:
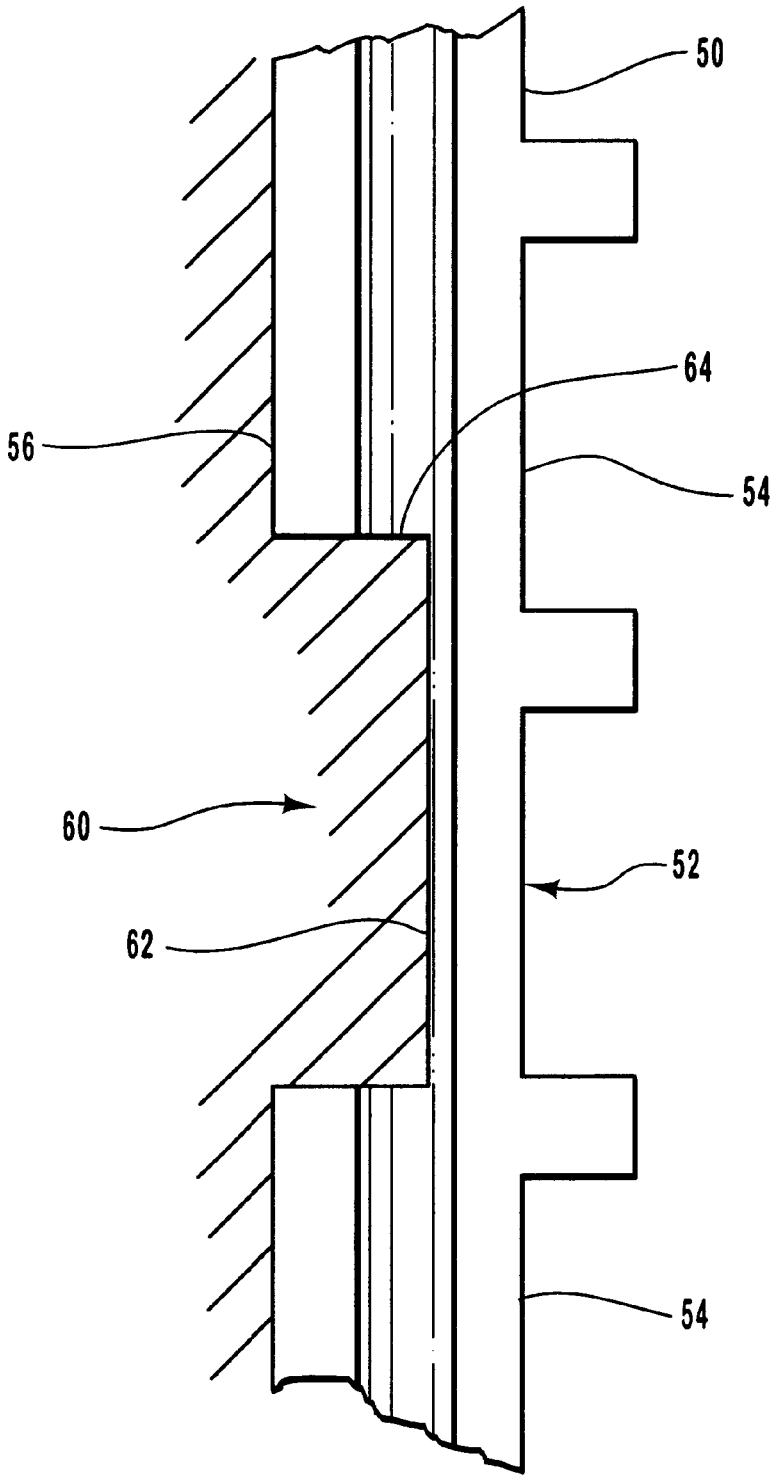
FIG. 3 is a side view of a second preferred embodiment of a polystyrene foam panel in accordance with the principles of the present invention.

FIG. 3 illustrates another preferred embodiment of a foam panel 50 in accordance with the principles of the present invention. The face 52 of the panel 50 has a similar configuration to the panel 12 previously discussed with reference to FIGS. 1 and 2. That is, the panel 50 is provided with channels 54 for receiving brick units to create a wall of brick. The back side 56 of the panel 50, however, is configured to match the contour of an existing structure 60. Often times, a building 60 will have an architectural feature 62 that is not desired to be visible. By utilizing the panel 50 of the present invention a recess 64 can be formed in the panel 50 to substantially match the shape of the architectural feature 62. When the panel 50 is attached to the structure 60, the recess 64 is fitted over the architectural feature 62 to hide that feature 62. When brick is attached to the face 52 of the panel in a manner previously described herein, the architectural feature 62 will not be visible.

Figure 4:
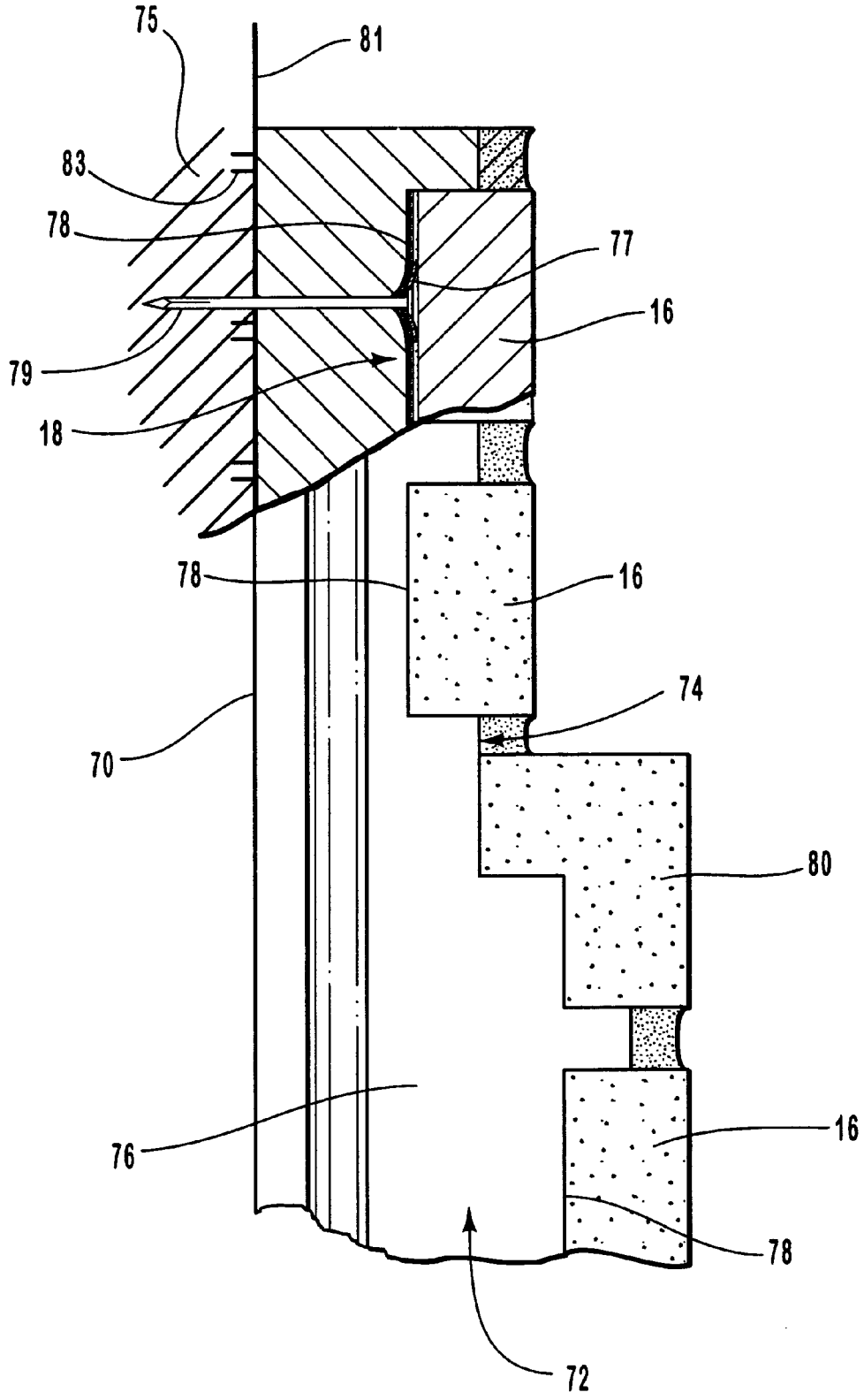
FIG. 4 is a side view of a third preferred embodiment of a polystyrene foam panel in accordance with the principles of the present invention.

In yet another preferred embodiment, FIG. 4 illustrates a panel 70 configured to add an architectural element 72 to an existing structure 75. The face 74 of the panel 70 includes a portion 76 which protrudes an additional amount from the face 74 of the panel 70. The panel 70 is configured with channels 78 similar to the other embodiments herein to receive brick units 16. The panel 70 can also be configured to receive different shapes of brick elements such as a corner brick unit 80. The corner brick unit 80 when applied to the panel 70 as illustrated gives the illusion that the brick units 16 have a standard brick thickness.

As shown in partial cross-section, the panel 70 is secured to the structure 75 with the fastener, generally indicated at 71. The fastener 71 is comprised of a washer member 77 and a mechanical fastener 79, such as a nail or a screw. The washer member 77 is preferably disc shaped as shown in FIG. 1 and includes a center aperture for receiving the fastener 79. The size of the washer member 77 is large enough to provide sufficient surface area on its back side to prevent or significantly reduce the possibility of the washer being pulled through the panel 70. The washer member 77 is held in place by the fastener 79 as the fastener 79 is secured to the structure 75 as by screwing (in the case of a threaded fastener) or hammering (in the case of a nail) the fastener 79 into the structure 75. Moreover, by placing the mesh strips 20 between the washer member 77 and the panel 70 as shown in FIG. 1, the mesh strips 20 further spread the forces of the washer 77 against the panel 70 over a larger surface area to further prevent the washers from being forced through the mesh panel 70.

Such fasteners 71 are utilized when the structure or substrate 75 to which the panel 70 is being attached is a wood-type construction. The fasteners 71 are preferably inserted into studs in order to assure a secure attachment. In such an application, the panel 70 is not typically adhesively attached to the structure 75. Instead, a layer of water repellant material 81, such as tar paper, is first attached to the structure as with staples 83. The tar paper may be overlapped to prevent water from seeping between adjacent sections of the tar paper. The panel 70 is then held in place merely by the fasteners 71. By doing so, water that finds its way behind the panel 70 can flow between the back side of the panel 70 and the tar paper 81 without becoming trapped therein between resulting in water damage (i.e., mildew, rot, etc.) of the structure 75.

Figure 5:
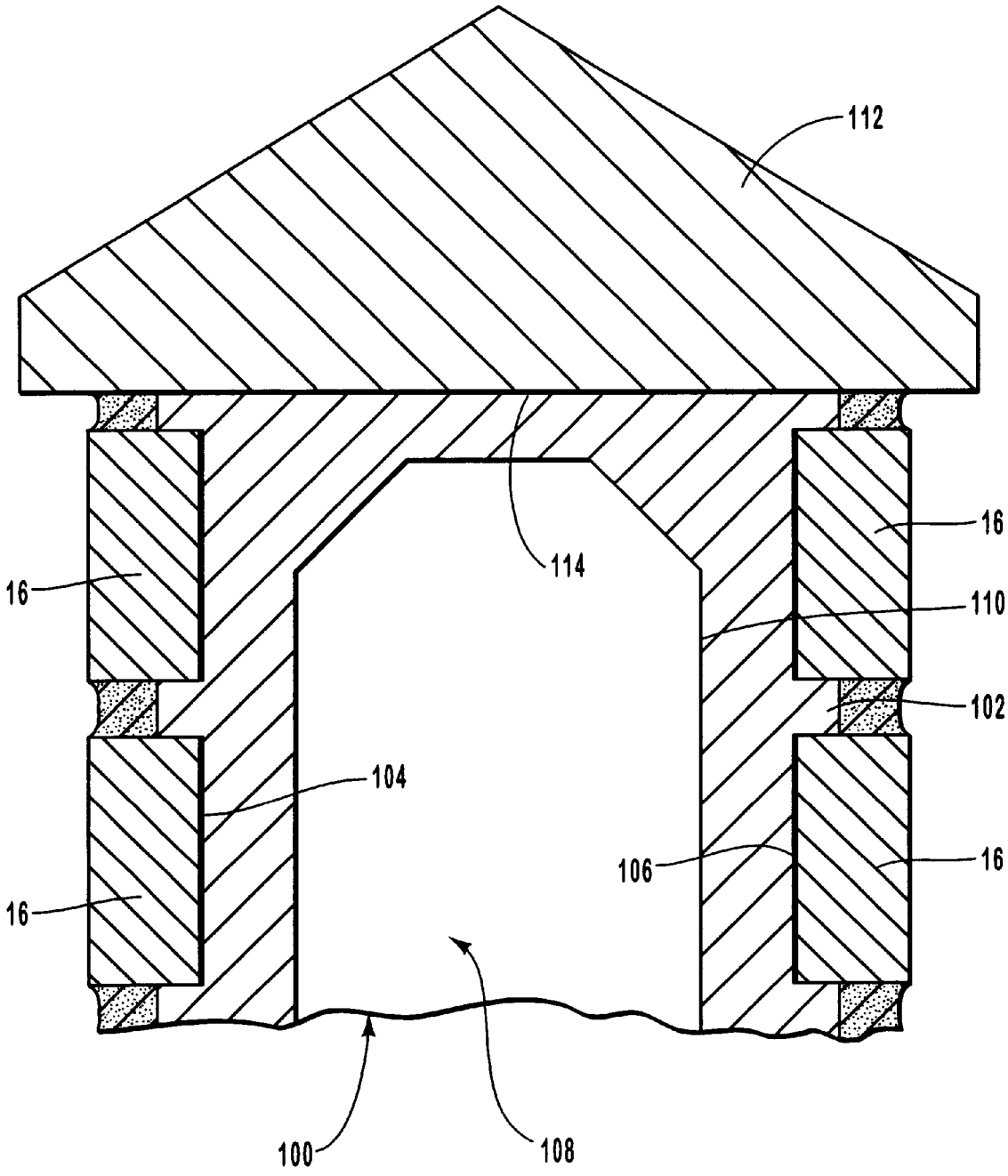
FIG. 5 is a side view of a fourth preferred embodiment of a polystyrene foam panel in accordance with the principles of the present invention.

Finally, as illustrated in FIG. 5, a foam panel structure 100 may form the architectural structure itself. For example, it is often desirable in residential settings to form brick covered pillars to house mail boxes. Accordingly, the pillar may be formed from a pillar shaped foam piece 102 that is configured on the outside to receive brick units 16 in a manner similar to the other panels herein discussed on the side surfaces 104 and 106. The interior 110 of the foam piece 102 defines a recess 108 configured to receive a mail box therein. The remaining sides of the foam piece 102 can be finished in a similar manner to the sides 104 and 106 to give the finished structure the appearance of a solid brick pillar. A cast cement top cap 112 can then be attached to the top 114 of the foam piece 102. Accordingly, the foam piece 102 provides the entire structure for attachment of exterior elements, such as brick, to give the appearance of a solid structure.

A significant advantage of the thin brick panel system of the present invention is that the brick is bonded directly to the foam panel. In addition, because mortar can bond to the foam panel, the mortar used to fill the gaps between adjacent bricks is secured to both the brick and the panel to prevent the mortar from becoming dislodged relative to the brick. Because the panel is formed from a flexible material, any expansion or contraction due to temperature variations between the adhesive and the foam panel can be absorbed by the foam panel.

It is also contemplated that other shapes of brick elements may benefit from the principles of the present invention. For example, the panels could be configured to receive various other brick and rock-like elements known in the art.

While the methods and apparatus of the present invention has been described with reference to certain preferred embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. An expanded polystyrene foam panel for use in a thin brick panel system with thin bricks, wherein the expanded polystyrene foam panel has a front side, a back side, a left side, a right side, a top side and a bottom side, wherein said back side has at least one depression adapted to provide increased surface area for an adhesive used to adhere the back side to a substrate, wherein said front side has a plurality of laterally extending channels that each are sized and adapted to receive a plurality of thin brick units initially held by an adhesive to the channels, wherein said channels are each defined by a pair of laterally extending spacing members that are integrally formed with said panel, wherein said plurality of laterally extending spacing members are positioned to provide proper spacing between the thin brick units to enable the thin brick units to form rows, and wherein each laterally extending spacing member has a height that is less than the thickness of the thin brick units and each laterally extending spacing member has a width that is sufficient to enable a mortar joint to be formed on each laterally extending spacing member between rows of thin brick units.

2. The panel of claim 1, wherein said panel includes mating features on at least one of said right side, said left side, said top side and said bottom side for mating with mating features on at least one of a right side, a left side, a top side and a bottom side of an adjacent panel.

3. The panel of claim 2, wherein said mating features include a tongue feature extending along said top side of said panel for mating with a groove feature along a bottom side of said adjacent panel.

4. The panel of claim 1, wherein said at least one depression includes at least one groove.

5. The panel of claim 1, wherein said plurality of laterally extending spacing members have a rectangular cross-section.

6. The panel of claim 4, wherein said at least one depression includes a plurality of grooves aligned with said spacing members.

7. The panel of claim 1, wherein said at least one depression includes a contour configured to match a feature of the substrate.

8. A thin brick panel system, comprising:

an expanded polystyrene foam panel for use with thin bricks; and mechanical fastening means for securing the panel to a substrate;

wherein the expanded polystyrene foam panel has a front side, a back side, a left side, a right side, a top side and a bottom side, wherein said back side has a plurality of depressions adapted to provide increased surface area for an adhesive used to adhere the back side to a substrate, wherein said front side has a plurality of laterally extending channels that each are sized and adapted to receive a plurality of thin brick units initially held by an adhesive to the channels, wherein said channels are each defined by a pair of laterally extending spacing members that are integrally formed with said panel, wherein said plurality of laterally extending spacing members are positioned to provide proper spacing between the thin brick units to enable the thin brick units to form rows, and wherein each laterally extending spacing member has a height that is less than the thickness of the thin brick units and each laterally extending spacing member has a width that is sufficient to enable a mortar joint to be formed on each laterally extending spacing member between rows of thin brick units.

9. The system of claim 8, wherein said mechanical fastening means comprises a washer member and a mechanical fastener inserted through said washer member.

10. The system of claim 8, further including a plurality of fabric-like strips of material seated within said channels of said panel between said panel and said plurality of brick units.

11. The system of claim 10, wherein said fabric-like strips of material have a length that is greater than a width of said panel for overlapping with an adjacent panel to bind together said panel and an adjacent panel.

12. A method of forming a wall of thin bricks, comprising:

providing an expanded polystyrene foam panel having a front side and a back side, said front side defining a plurality of laterally extending channels, said channels each defined by a pair of laterally extending spacing members integrally formed with said panel;

wherein said plurality of laterally extending spacing members are positioned to provide proper spacing between the thin brick units to enable the thin brick units to form rows, and fastening said panel to a substrate by applying an adhesive to the back side of the panel and into at least one depression in the back side;

applying an adhesive to the panel within said plurality of channels; and pressing a plurality of thin brick units into said adhesive and within said plurality of channels;

wherein each laterally extending spacing member has a height that is less than the thickness of the thin brick units and each laterally extending spacing member has a width that is sufficient to enable a mortar joint to be formed on each laterally extending spacing member between rows of thin brick units.

13. The method of claim 12, wherein said panel has a top side and a bottom side and wherein said panel includes mating features on the top side and the bottom side for mating with adjacent panes and further including abutting panels together and joining together said mating features of said adjacent panels.

14. The method of claim 13, wherein said mating features include a tongue feature extending along said top side of said panel for mating with a groove feature extending along a bottom side of a second panel and further including mating said panel with a second panel.

15. The method of claim 12, further including applying mortar within said mortar joint.

16. The method of claim 12, further including mechanically fastening said panel to a substrate.

17. The method of claim 16, wherein mechanically fastening said panel to the substrate involves obtaining a washer member and a mechanical fastener and then inserting the mechanical fastener through said washer member and into the existing substrate.

18. The method of claim 12, further including attaching a plurality of fabric-like strips of material within said channels of said panel prior to application of said brick units in said-channels of said panel.

19. The method of claim 18, further including providing said fabric-like strips of material with a length that is greater than a width of said panel and overlapping said material with an adjacent panel to bind together said panel and an adjacent panel.

20. The method of claim 19, wherein said at least one depression in the back side of said panel includes at least one of a groove and a contour configured to match a feature of the substrate.

* * * * *